US008749172B2

(12) United States Patent
Knapp

(10) Patent No.: US 8,749,172 B2
(45) Date of Patent: Jun. 10, 2014

(54) LUMINANCE CONTROL FOR ILLUMINATION DEVICES

(75) Inventor: David J. Knapp, Austin, TX (US)

(73) Assignee: Ketra, Inc., Austin, TX (US)

( * ) Notice: Subject to any disclaimer, the term of this patent is extended or adjusted under 35 U.S.C. 154(b) by 148 days.

(21) Appl. No.: 13/178,686

(22) Filed: Jul. 8, 2011

(65) Prior Publication Data

US 2013/0009551 A1 Jan. 10, 2013

(51) Int. Cl.
*H05B 37/02* (2006.01)

(52) U.S. Cl.
USPC ..... 315/307; 315/185 R; 315/294

(58) Field of Classification Search
USPC ..... 315/185 R, 192, 291, 297, 307, 308, 312
See application file for complete search history.

(56) References Cited

U.S. PATENT DOCUMENTS

| | | | |
|---|---|---|---|
| 4,029,976 | A | 6/1977 | Fish et al. |
| 4,402,090 | A | 8/1983 | Gfeller et al. |
| 4,713,841 | A | 12/1987 | Porter et al. |
| 4,809,359 | A | 2/1989 | Dockery |
| 5,103,466 | A | 4/1992 | Bazes |
| 5,181,015 | A | 1/1993 | Marshall et al. |
| 5,299,046 | A | 3/1994 | Spaeth et al. |
| 5,317,441 | A | 5/1994 | Sidman |
| 5,541,759 | A | 7/1996 | Neff et al. |
| 5,619,262 | A | 4/1997 | Uno |
| 5,657,145 | A | 8/1997 | Smith |
| 6,016,038 | A | 1/2000 | Mueller et al. |
| 6,067,595 | A | 5/2000 | Lindenstruth |
| 6,108,114 | A | 8/2000 | Gilliland et al. |
| 6,150,774 | A | 11/2000 | Mueller et al. |
| 6,234,645 | B1 | 5/2001 | Borner et al. |
| 6,234,648 | B1 | 5/2001 | Borner et al. |
| 6,250,774 | B1 | 6/2001 | Begemann et al. |
| 6,384,545 | B1 | 5/2002 | Lau |
| 6,396,815 | B1 | 5/2002 | Greaves et al. |

(Continued)

FOREIGN PATENT DOCUMENTS

| | | |
|---|---|---|
| CN | 101083866 | 12/2007 |
| CN | 101150904 | 3/2008 |

(Continued)

OTHER PUBLICATIONS

International Search Report & Written Opinion mailed Sep. 19, 2012.

(Continued)

*Primary Examiner* — Tung X Le
(74) *Attorney, Agent, or Firm* — Kevin L. Daffer; Daffer McDaniel LLP

(57) ABSTRACT

An illumination device is provided having one or more illumination LEDs configured to provide illumination for the device. Along with the illumination LED is a reference LED. The illumination LED provide illumination during normal operation of the device, whereas the reference LED provides a reference illumination, but does not provide illumination during normal operation. A light detector can detect light from the illumination LED and the reference LED, and control circuitry can be used to compare light detected from the reference LED and the illumination LED to adjust a brightness for the device. The light detector can comprise a photodetector or can comprise an LED, such as one of the illumination LEDs if more than one illumination LED is utilized. A method is also provided for controlling brightness of an illumination device.

20 Claims, 2 Drawing Sheets

(56) References Cited

U.S. PATENT DOCUMENTS

| | | | | |
|---|---|---|---|---|
| 6,414,661 | B1 | 7/2002 | Shen et al. | |
| 6,441,558 | B1 | 8/2002 | Muthu et al. | |
| 6,498,440 | B2 | 12/2002 | Stam et al. | |
| 6,513,949 | B1 | 2/2003 | Marshall et al. | |
| 6,617,795 | B2 | 9/2003 | Bruning | |
| 6,636,003 | B2 | 10/2003 | Rahm et al. | |
| 6,639,574 | B2 | 10/2003 | Scheibe | |
| 6,664,744 | B2 | 12/2003 | Dietz | |
| 6,692,136 | B2 | 2/2004 | Marshall et al. | |
| 6,753,661 | B2 | 6/2004 | Muthu et al. | |
| 6,788,011 | B2 | 9/2004 | Mueller et al. | |
| 6,806,659 | B1 | 10/2004 | Mueller et al. | |
| 6,831,569 | B2 | 12/2004 | Wang et al. | |
| 6,831,626 | B2 | 12/2004 | Nakamura et al. | |
| 6,853,150 | B2 | 2/2005 | Clauberg et al. | |
| 6,879,263 | B2 | 4/2005 | Pederson et al. | |
| 6,969,954 | B2 | 11/2005 | Lys | |
| 6,975,079 | B2 | 12/2005 | Lys et al. | |
| 7,014,336 | B1 | 3/2006 | Ducharme et al. | |
| 7,038,399 | B2 | 5/2006 | Lys et al. | |
| 7,046,160 | B2 | 5/2006 | Pederson et al. | |
| 7,072,587 | B2 | 7/2006 | Dietz et al. | |
| 7,088,031 | B2 | 8/2006 | Brantner et al. | |
| 7,135,824 | B2 | 11/2006 | Lys et al. | |
| 7,161,311 | B2 | 1/2007 | Mueller et al. | |
| 7,166,966 | B2 | 1/2007 | Naugler, Jr. et al. | |
| 7,233,115 | B2 | 6/2007 | Lys | |
| 7,233,831 | B2 | 6/2007 | Blackwell | |
| 7,252,408 | B2 | 8/2007 | Mazzochette et al. | |
| 7,255,458 | B2 | 8/2007 | Ashdown | |
| 7,256,554 | B2 | 8/2007 | Lys | |
| 7,294,816 | B2 | 11/2007 | Ng et al. | |
| 7,315,139 | B1 | 1/2008 | Selvan et al. | |
| 7,329,998 | B2 | 2/2008 | Jungwirth | |
| 7,330,002 | B2 | 2/2008 | Joung | |
| 7,358,706 | B2 | 4/2008 | Lys | |
| 7,359,640 | B2 | 4/2008 | Onde et al. | |
| 7,372,859 | B2 | 5/2008 | Hall et al. | |
| 7,400,310 | B2 | 7/2008 | LeMay | |
| 7,445,340 | B2 | 11/2008 | Conner et al. | |
| 7,511,695 | B2 | 3/2009 | Furukawa et al. | |
| 7,525,611 | B2 | 4/2009 | Zagar et al. | |
| 7,554,514 | B2 | 6/2009 | Nozawa | |
| 7,573,210 | B2 * | 8/2009 | Ashdown et al. | 315/307 |
| 7,583,901 | B2 | 9/2009 | Nakagawa et al. | |
| 7,606,451 | B2 | 10/2009 | Morita | |
| 7,607,798 | B2 | 10/2009 | Panotopoulos | |
| 7,659,672 | B2 * | 2/2010 | Yang | 315/224 |
| 7,683,864 | B2 | 3/2010 | Lee et al. | |
| 7,737,936 | B2 | 6/2010 | Daly | |
| 8,018,135 | B2 | 9/2011 | Van De Ven et al. | |
| 8,040,299 | B2 | 10/2011 | Kretz et al. | |
| 8,044,899 | B2 | 10/2011 | Ng et al. | |
| 8,044,918 | B2 | 10/2011 | Choi | |
| 8,076,869 | B2 * | 12/2011 | Shatford et al. | 315/294 |
| 8,159,150 | B2 | 4/2012 | Ashdown et al. | |
| 8,174,205 | B2 | 5/2012 | Myers et al. | |
| 8,283,876 | B2 | 10/2012 | Ji | |
| 2001/0020123 | A1 | 9/2001 | Diab et al. | |
| 2002/0014643 | A1 | 2/2002 | Kubo et al. | |
| 2002/0049933 | A1 | 4/2002 | Nyu | |
| 2003/0122749 | A1 | 7/2003 | Booth, Jr. et al. | |
| 2004/0052076 | A1 | 3/2004 | Mueller et al. | |
| 2004/0052299 | A1 | 3/2004 | Jay et al. | |
| 2004/0136682 | A1 | 7/2004 | Watanabe | |
| 2004/0201793 | A1 | 10/2004 | Anandan et al. | |
| 2005/0004727 | A1 | 1/2005 | Remboski et al. | |
| 2005/0030203 | A1 | 2/2005 | Sharp et al. | |
| 2005/0030267 | A1 | 2/2005 | Tanghe et al. | |
| 2005/0053378 | A1 | 3/2005 | Stanchfield et al. | |
| 2005/0110777 | A1 | 5/2005 | Geaghan et al. | |
| 2005/0169643 | A1 | 8/2005 | Franklin | |
| 2005/0200292 | A1 | 9/2005 | Naugler, Jr. et al. | |
| 2005/0242742 | A1 | 11/2005 | Cheang et al. | |
| 2006/0145887 | A1 | 7/2006 | McMahon | |
| 2006/0164291 | A1 | 7/2006 | Gunnarsson | |
| 2006/0198463 | A1 | 9/2006 | Godin | |
| 2006/0220990 | A1 | 10/2006 | Coushaine et al. | |
| 2006/0227085 | A1 | 10/2006 | Boldt, Jr. et al. | |
| 2007/0040512 | A1 | 2/2007 | Jungwirth et al. | |
| 2007/0109239 | A1 | 5/2007 | den Boer et al. | |
| 2007/0132592 | A1 | 6/2007 | Stewart et al. | |
| 2007/0139957 | A1 | 6/2007 | Haim et al. | |
| 2007/0248180 | A1 | 10/2007 | Bowman et al. | |
| 2007/0254694 | A1 | 11/2007 | Nakagwa et al. | |
| 2007/0279346 | A1 | 12/2007 | den Boer et al. | |
| 2008/0107029 | A1 | 5/2008 | Hall et al. | |
| 2008/0136770 | A1 * | 6/2008 | Peker et al. | 345/102 |
| 2008/0136771 | A1 | 6/2008 | Chen et al. | |
| 2008/0150864 | A1 | 6/2008 | Bergquist | |
| 2008/0186898 | A1 | 8/2008 | Petite | |
| 2008/0222367 | A1 | 9/2008 | Co | |
| 2008/0235418 | A1 | 9/2008 | Werthen et al. | |
| 2008/0253766 | A1 | 10/2008 | Yu et al. | |
| 2008/0265799 | A1 | 10/2008 | Sibert | |
| 2008/0297070 | A1 | 12/2008 | Kuenzler et al. | |
| 2008/0304833 | A1 | 12/2008 | Zheng | |
| 2008/0309255 | A1 | 12/2008 | Myers et al. | |
| 2009/0026978 | A1 | 1/2009 | Robinson | |
| 2009/0040154 | A1 | 2/2009 | Scheibe | |
| 2009/0049295 | A1 | 2/2009 | Erickson et al. | |
| 2009/0171571 | A1 | 7/2009 | Son et al. | |
| 2009/0196282 | A1 | 8/2009 | Fellman et al. | |
| 2009/0245101 | A1 | 10/2009 | Kwon et al. | |
| 2009/0284511 | A1 | 11/2009 | Takasugi et al. | |
| 2010/0005533 | A1 | 1/2010 | Shamir | |
| 2010/0061734 | A1 | 3/2010 | Knapp | |
| 2010/0096447 | A1 | 4/2010 | Kwon et al. | |
| 2010/0134021 | A1 | 6/2010 | Ayres | |
| 2010/0182294 | A1 | 7/2010 | Roshan et al. | |
| 2010/0188972 | A1 | 7/2010 | Knapp | |
| 2010/0194299 | A1 * | 8/2010 | Ye et al. | 315/192 |
| 2010/0272437 | A1 | 10/2010 | Yoon et al. | |
| 2010/0327764 | A1 | 12/2010 | Knapp | |
| 2011/0031894 | A1 | 2/2011 | Van De Ven | |
| 2011/0044343 | A1 | 2/2011 | Sethuram et al. | |
| 2011/0052214 | A1 | 3/2011 | Shimada et al. | |
| 2011/0062874 | A1 | 3/2011 | Knapp | |
| 2011/0063214 | A1 | 3/2011 | Knapp | |
| 2011/0063268 | A1 | 3/2011 | Knapp | |
| 2011/0068699 | A1 | 3/2011 | Knapp | |
| 2011/0069094 | A1 | 3/2011 | Knapp | |
| 2011/0069960 | A1 | 3/2011 | Knapp et al. | |
| 2011/0133654 | A1 | 6/2011 | McKenzie et al. | |
| 2011/0148315 | A1 * | 6/2011 | Van Der Veen et al. | 315/217 |
| 2011/0253915 | A1 | 10/2011 | Knapp | |
| 2011/0299854 | A1 | 12/2011 | Jonsson et al. | |
| 2011/0309754 | A1 | 12/2011 | Ashdown et al. | |
| 2012/0229032 | A1 * | 9/2012 | Van De Ven et al. | 315/151 |
| 2012/0306370 | A1 | 12/2012 | Van De Ven et al. | |
| 2013/0016978 | A1 | 1/2013 | Son et al. | |

FOREIGN PATENT DOCUMENTS

| | | |
|---|---|---|
| CN | 101458067 | 6/2009 |
| EP | 0196347 | 10/1986 |
| EP | 0456462 | 11/1991 |
| GB | 2307577 | 5/1997 |
| JP | 06-302384 | 10/1994 |
| JP | 08-201472 | 8/1996 |
| JP | 11-025822 | 1/1999 |
| JP | 2001-514432 | 9/2001 |
| JP | 2007-266974 | 10/2007 |
| WO | 2010/124315 | 11/2010 |

OTHER PUBLICATIONS

Final Office Action mailed Nov. 28, 2011 for U.S. Appl. No. 12/360,467.

Notice of Allowance mailed Jan. 20, 2012 for U.S. Appl. No. 12/360,467.

Office Action Mailed Feb. 1, 2012 for U.S. Appl. No. 12/584,143.

Final Office Action Mailed Sep. 12, 2012 for U.S. Appl. No. 12/584,143.

(56) References Cited

OTHER PUBLICATIONS

Office Action Mailed Aug. 2, 2012 for U.S. Appl. No. 12/806,114.
Office Action Mailed Oct. 2, 2012 for U.S. Appl. No. 12/806,117.
Office Action Mailed Jul. 11, 2012 for U.S. Appl. No. 12/806,121.
Final Office Action Mailed Oct. 11, 2012 for U.S. Appl. No. 12/806,121.
Office Action mailed Dec. 17, 2012 for U.S. Appl. No. 12/806,118.
Office Action mailed Oct. 9, 2012 for U.S. Appl. No. 12/806,126.
Office Action mailed Jul. 10, 2012 for U.S. Appl. No. 12/806,113.
Notice of Allowance mailed Oct. 15, 2012 for U.S. Appl. No. 12/806,113.
Partial International Search Report mailed Nov. 16, 2012 for PCT/US2012/052774.
Notice of Allowance mailed Feb. 4, 2013 for U.S. Appl. No. 12/809,113.
Notice of Allowance mailed Feb. 25, 2013 for U.S. Patent Appl. No. 12/806,121.
Notice of Allowance mailed May 3, 2013 for U.S. Appl. No. 12/806,126.
International Search Report & Written Opinion, PCT/US2013/027157, May 16, 2013.
Hall et al., "Jet Engine Control Using Ethernet with a Brain (Postprint)," AIAA/ASME/SAE/ASEE Joint Propulsion Conference and Exhibition, Jul. 2008, pp. 1-18.
Kebemou, "A Partitioning-Centric Approach for the Modeling and the Methodical Design of Automotive Embedded System Architectures," Dissertation of Technical University of Berlin, 2008, 176 pages.
O'Brien et al., "Visible Light Communications and Other Developments in Optical Wireless," Wireless World Research Forum, 2006, 26 pages.
Zalewski et al., "Safety Issues in Avionics and Automotive Databuses," IFAC World Congress, Jul. 2005, 6 pages.
"Visible Light Communication: Tutorial," Project IEEE P802.15 Working Group for Wireless Personal Area Networks (WPANs), Mar. 2008.
International Search Report & Written Opinion, PCT/US2010/000219, mailed Oct. 12, 2010.
International Search Report & Written Opinion, PCT/US2010/002171, mailed Nov. 24, 2010.
International Search Report & Written Opinion, PCT/US2010/004953, mailed Mar. 22, 2010.
International Search Report & Written Opinion, PCT/US2010/001919, mailed Feb. 24, 2011.
U.S. Appl. No. 12/924,628, filed Sep. 30, 2010.
Office Action mailed May 12, 2001 for U.S. Appl. No. 12/360,467.
International Search Report & Written Opinion for PCT/US2012/052774 mailed Feb. 4, 2013.
Office Action mailed Nov. 12, 2013 for U.S. Appl. No. 13/231,077.
Johnson, "Visibile Light Communications," CTC Tech Brief, Nov. 2009, 2 pages.
Chonko, "Use Forward Voltage Drop to Measure Junction Temperature," © 2013 Penton Media, Inc., 5 pages.
Office Action mailed Oct. 24, 2013 for U.S. Appl. No. 12/806,117.
Notice of Allowance mailed Oct. 31, 2013 for U.S. Appl. No. 12/924,628.
Final Office Action mailed Jul. 9, 2013 for U.S. Appl. No. 12/806,118.
Office Action mailed Dec. 4, 2013 for U.S. Appl. No. 12/803,805.
Office Action mailed Nov. 4, 2013 for CN Application No. 201080032373.7.
Office Action mailed Jun. 10, 2013 for U.S. Appl. No. 12/924,628.
Final Office Action mailed Jun. 14, 2013 for U.S. Appl. No. 12/806,117.
Notice of Allowance mailed Feb. 21, 2014 for U.S. Appl. No. 12/806,118.

* cited by examiner

LUMINANCE CONTROL FOR ILLUMINATION DEVICES

RELATED APPLICATIONS

This application is related to the following co-pending applications: U.S. patent application Ser. No. 12/806,114 filed Aug. 5, 2010; U.S. patent application Ser. No. 12/806,117 filed Aug. 5, 2010; U.S. patent application Ser. No. 12/806,121 filed Aug. 5, 2010; U.S. patent application Ser. No. 12/806,118 filed Aug. 5, 2010; U.S. patent application Ser. No. 12/806,113 filed Aug. 5, 2010; and U.S. patent application Ser. No. 12/806,126 filed Aug. 5, 2010; each of which is hereby incorporated by reference in its entirety.

BACKGROUND

1. Field of the Invention

The invention relates to the addition of an LED (light emitting diode) to an illumination device to be used as reference light source to maintain brightness over lifetime.

2. Description of Related Art

Lamps and displays using LEDs (light emitting diodes) for illumination are becoming increasingly popular in many different markets. LEDs provide a number of advantages over traditional light sources, such as fluorescent lamps, including low power consumption, long lifetime, and no hazardous material, and additional specific advantages for different applications. For instance, LEDs are rapidly replacing Cold Cathode Fluorescent Lamps (CCFL) as LCD backlights due to smaller form factor and wider color gamut. LEDs for general illumination provide the opportunity to adjust the color or white color temperature for different effects. LED billboards are replacing paper billboards to enable multiple advertisements to timeshare a single billboard. Further, projectors that use LEDs as the light source may become popular in mobile handsets, such as smartphones, in the near future. Likewise, Organic LEDs or OLEDs, which use multi-colored LEDs directly to produce light for each display pixel, and which use arrays of organic LEDs constructed on planar substrates, may also become popular for many types of display applications.

Although LEDs have many advantages over conventional light sources, such as incandescent and fluorescent light bulbs, a disadvantage of LEDs is that the brightness produced by a fixed current can change over time. For instance, during the earliest phase of an LED life cycle, the optical output power can increase or decrease depending on whether defects in the active region grow or shrink. During the later phases of an LED's lifecycle, the optical output power for a given drive current continually decreases until replaced. Unlike a conventional incandescent or fluorescent light bulb that typically fails catastrophically, a typical LED lamp will just get dimmer over time, which can be an issue if one lamp in an array of LED lamps has to be replaced before the others. The new lamp typically will appear brighter than the rest, which may not be acceptable in some applications.

Although most commercially available LED lamps today do not compensate for light output degradation over time, some lamps, such the LR6 available from Cree, have photo-detectors and optical feedback circuitry to monitor and adjust output intensity. Such lamps, however, are typically more expensive than those without such compensation circuitry. Additionally, such compensation circuitry can be adversely affected by temperature and other variations in operating conditions, which either degrade performance or require cost and complexity to compensate.

As such, a need exists for a improved techniques to maintain a fixed brightness produced by an LED lamp without the cost and complexity of conventional photo-detector based optical feedback circuitry.

SUMMARY OF THE INVENTION

Systems and methods are disclosed for luminance control of illumination devices that maintain relatively fixed brightness over time. Embodiments disclosed provide illumination devices and related methods that utilize LEDs (light emitting diode) as reference light sources, and these embodiments allow for fixed brightness to be maintained and produced by an LED (light emitting diode) lamp over the lifetime of the product. As described herein, various embodiments may be utilized, and a variety of features and variations can be implemented, as desired, and related systems and methods can be utilized as well.

There are two example embodiments along with various variations described herein that use an additional LED as a reference light source to which the brightness of the lamp is compared. Depending on such comparison, the drive currents to the LEDs used for illumination are then adjusted to produce a desired ratio of light between the reference LED and the illumination LEDs. As described in more detail below, the first embodiment uses an additional light detector to detect the light produced, and the second embodiment uses one or more of the illumination LEDs that produce the illumination for the illumination device as both light emitters and light detectors.

While the LEDs producing illumination in a lamp for instance degrade over time, the additional reference LED will not degrade or will degrade significantly less over time because it can be used infrequently and at a lower current density than the LEDs being used to produce the illumination for the device. As such the brightness of the reference LED stays relatively constant over lifetime and provides a reference light level to which the LEDs used for illumination are compared. Preferentially the reference LED can be implemented as a blue LED, if desired, because current blue LEDs vary the least over temperature as compared to other LEDs. Other LEDs having a different color could also be used for the reference LED, if desired.

The first embodiment described herein uses an additional light detector, such as a photo-detector, to measure the ratio of optical power produced by the reference LED over the optical power produced by the illumination LEDs used for illumination. Such a photo-detector can be, for example, a simple and inexpensive silicon diode. And the reference LED can be, for example, a blue LED. Because the optical output power from a blue LED is relatively insensitive to temperature and because the photo-detector is measuring ratios of optical power, temperature and other conditions that can affect the current induced in the silicon diode by incident light can effectively be ignored. As such, these temperature and other operating conditions do not have to be compensated for, which simplifies the optical feedback control circuitry and reduces cost.

The second embodiment described herein further reduces cost by using one or more of the illumination LEDs already within the LED illumination device to detect the power ratios, thereby eliminating the need for an additional photo-detector. For these embodiments, one or more of the illumination LEDs that are used for illumination are also used to detect the ratio of optical power produced by the reference LED over the optical power produced by the illumination LEDs. In these embodiments, the LEDs that provide illumination can also be configured in at least two separate chains that are controlled independently. A first LED chain (e.g., one or more LEDs) measures the ratio of light from the reference LED over the light produced by a second LED chain (e.g., one or more LEDs), and the second LED chain measures the ratio of light from the reference LED over the light produced by the first chain. As such the light produced by each LED chain can be measured and adjusted to a desired value, such as a fixed value, resulting in the combined light from both LED chains remaining at a fixed level.

In both embodiments, the ratios of optical power can be measured more or less frequently depending on the application. For instance, the ratios could be measured and adjusted every time the illumination device is turned on. Alternatively, the ratios of optical power could be measured periodically during normal operation. For instance, the ratio measurements could be taken very quickly and imperceptibly every minute or so. Further, if desired, the ratio measurements could be made at long time intervals, depending upon the operation desired.

Advantageously, the embodiments disclosed herein address problems in prior solutions with the addition of an LED to an illumination device that is then used as a reference light source. As such, the cost and complexity of the optical feedback circuitry typically used to monitor illumination device brightness can be reduced for some applications by the embodiments described herein.

An illumination device is provided in one embodiment. The illumination device comprises one or more illumination LEDs that are configured to provide illumination for the device during normal operation of the device. When the device is called upon to provide illumination, the illumination LEDs are active. The illumination device further comprises driver circuitry coupled to the illumination LEDs for driving the illumination LEDs during illumination operation of the device. At least one reference LED is also provided which operates only during test, but does not operate during normal illumination operation. Thus, the reference LED is used less frequently (i.e., only during test, but not during normal operation) which proves advantageous in extending the longevity of the reference LED providing operation as a reference output that does not significantly change throughout multiple tests.

The illumination device also comprises a light detector circuitry which detects light from the illumination LEDs and the reference LED. Control circuitry is coupled to the light detector circuitry and the driver circuitry. The control circuitry makes a comparison, such as a ratio, of light detected from the reference LED and the light detected from the LEDs. Based on that comparison, the control circuitry adjusts a brightness for the illumination device through control of the driver circuitry.

The light detector circuitry can comprise a photo-detector or one of the illumination LEDs. The illumination LEDs can be, e.g., red LEDs, which illuminate in the red visual spectrum. A third illumination LED may be implemented and can comprise a white LED which emits in the white visual spectrum. As such, the reference LED can comprise a blue LED that emits in the blue visual spectrum.

According to another embodiment, a method is provided for controlling a brightness for an illumination device. The method comprises detecting light produced by a reference LED and detecting light produced by one or more illumination LEDs of the illumination device. The light produced by the reference LED and the illumination LEDs can be compared. Based on that comparison, a brightness for the illumination device can be adjusted.

DESCRIPTION OF THE DRAWINGS

Other objects and advantages of the invention will become apparent upon reading the following detailed description and upon reference to the accompanying drawings.

Figure 1:
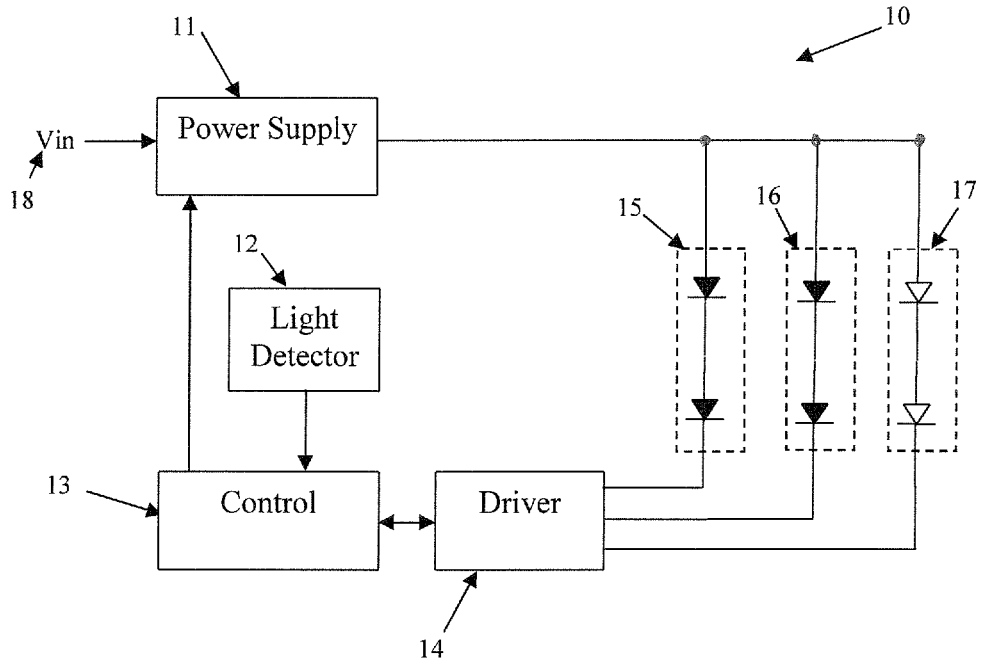
FIG. 1 is an exemplary block diagram for a conventional LED lamp that uses a light detector to maintain a fixed brightness over lifetime.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Systems and methods are disclosed for luminance control of illumination devices that maintain relatively fixed brightness over time. Embodiments disclosed provide illumination devices and related methods that utilize LEDs (light emitting diode) as reference light sources, and these embodiments allow for fixed brightness to be maintained and produced by an LED (light emitting diode) lamp over the lifetime of the product. As described herein, various embodiments may be utilized, and a variety of features and variations can be implemented, as desired, and related systems and methods can be utilized as well.

Turning now to the drawings, FIG. 1 is an example block diagram for circuitry in a conventional LED lamp 10 that includes a light detector 12 to monitor the brightness of light produced by LED chains 15, 16, and 17. Power supply 11 converts a voltage input (Vin) 18 to one or more voltages that are used to operate LED chains 15, 16, and 17, and that are also used to operate light detector 12, control circuitry 13, and driver 14. Typically, the voltage input (Vin) 18 is provided by the AC mains.

Light detector 12 is typically implemented as a silicon photo-diode that produces a current proportional to the light produced by LED chains 15, 16, and 17. Control circuitry 13 digitizes the current from light detector 12 and communicates with driver 14 to adjust the current applied to LED chains 15, 16, and 17 such that the current induced in light detector 12 remains unchanged. As LED chains 15, 16, and 17 age, the light produced by such LED chains 15, 16, and 17 changes. Feedback provided by light detector 12 enables the drive currents produced by driver 14 for the LED chains 15, 16 and 17 to be adjusted to produce a relatively fixed brightness from LED chains 15, 16, and 17 over lifetime.

The accuracy of the brightness control in such a conventional LED lamp illustrated by this FIG. 1 is dependent on the stability of the photo-current produced by the photo-detector 12 over operating conditions.

FIG. 1 is just one of many possible block diagrams for a conventional LED lamp 10 that actively monitors and controls the brightness of such lamp using a light detector. For example, various types and combinations of implementations for power supply 11 and driver 14 are possible to drive more or fewer chains of any number of LEDs (e.g., one or more), as desired, depending upon an implementation being utilized for lamp 10.

Figure 2:
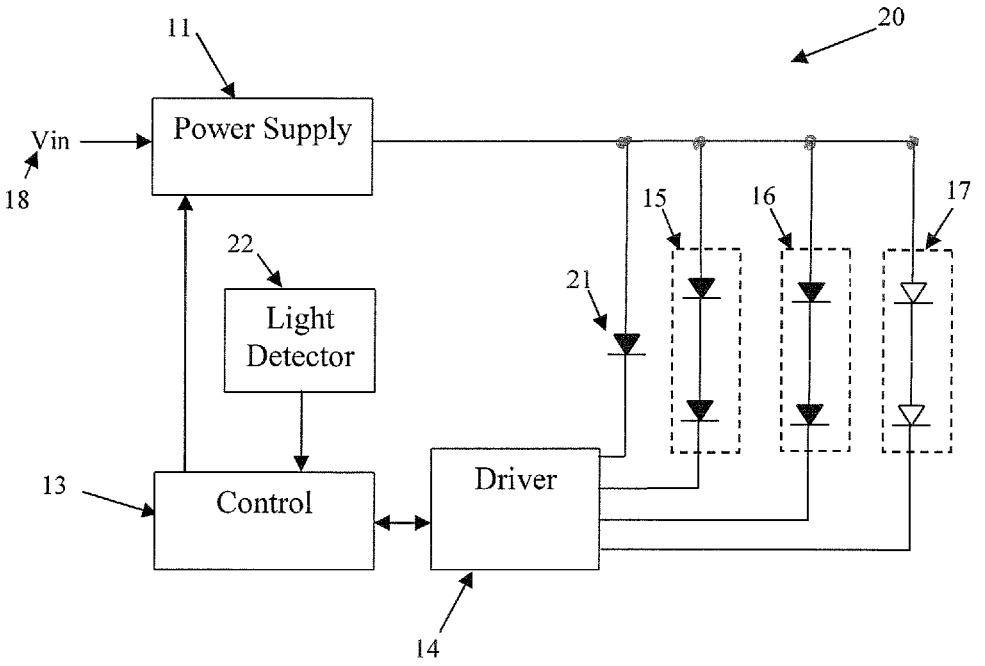
FIG. 2 is an exemplary block diagram for an improved LED lamp that uses a reference LED and a light detector to maintain a fixed brightness over lifetime.

FIG. 2 is an example block diagram of an improved LED lamp 20 that uses a reference LED 21 in combination with light detector 22 to maintain a fixed brightness over lifetime. The reference LED 21 is periodically turned on, and light detector 22 in combination with control circuitry 13 measures the light produced by LED 21 relative to the light produced by LED chains 15, 16, and 17. Because light detector 22 is used to measure relative amounts or ratios of light, the absolute accuracy of light detector 22 is not important and consequently such light detector 22 can be inexpensive. Further, LED 21 can be used relatively infrequently with respect to the LED chains 15, 16 and 17. Reference LED 21 is an LED that is used only during test or reference testing, but is not used for illumination during non-test times. As such, the brightness of light produced by such LED 21 does not diminish or change significantly over the lifetime of lamp 20, as compared to the illumination LEDs used for illumination of the device, and consequently the reference LED 21 provides a relatively fixed reference to which the brightness of lamp 20 can be compared. Any detected variations in brightness can be compensated by adjusting the LED current magnitude or duty cycle of the relative drive currents produced by driver 14 for the LED chains 15, 16 and 17.

FIG. 2 is just one of many possible block diagrams for an improved LED lamp 20 that can be configured to use a reference LED 21 and an inexpensive light detector 22 to maintain a fixed brightness over lifetime. For example, various configurations of power supply 11 and driver 14 are possible to drive more or fewer chains of any number of LEDs (e.g., one or more), as desired, depending upon an implementation being utilized for lamp 20. The LEDs can also be any desired color. For example, for a white lamp 20, LED chains 15 and 16 can be implemented as one or more red LEDs, and LED chain 17 can be implemented as one or more white LEDs. Further, the reference LED 21 can also be implemented as a blue LED, if desired. Other LEDs configurations could also be used, as desired. It is further noted that the voltage input (Vin) 18 can again be the AC mains; however, the voltage input (Vin 18) can also be any other AC (alternating current) or DC (direct current) voltage supply input, as desired.

Figure 3:
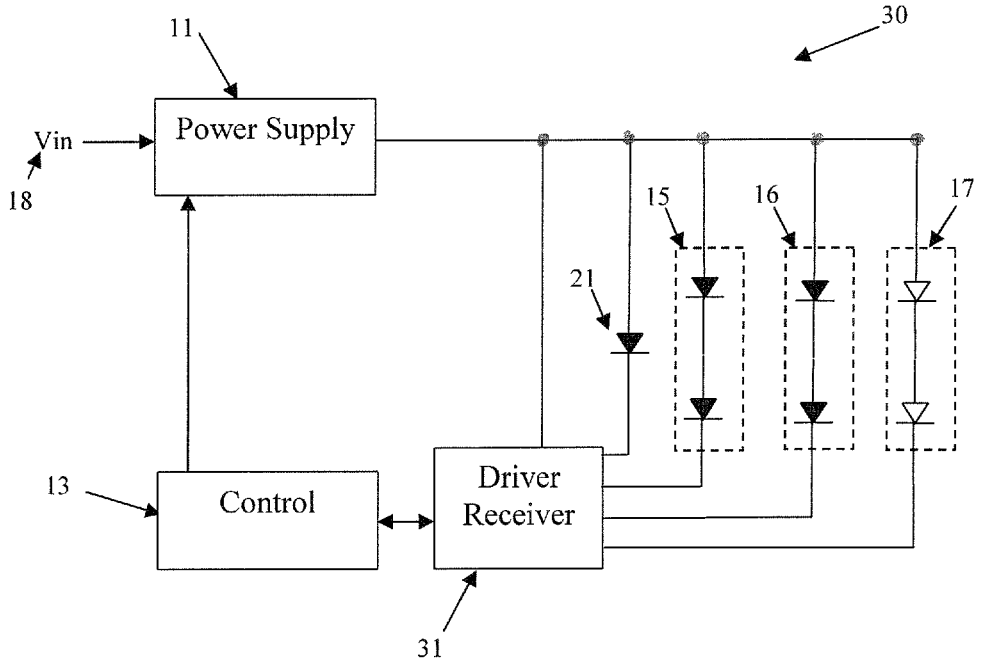
FIG. 3 is an exemplary block diagram for an improved LED lamp that uses a reference LED without an additional light detector to maintain a fixed brightness over lifetime.

FIG. 3 is an example block diagram of an improved LED lamp 30 that uses a reference LED 21 without an additional light detector 22 to maintain a fixed brightness over lifetime. As in FIG. 2, LED 21 is periodically turned on; however, LED chains 15 and 16 are used as light detectors to determine the relative amounts of light produced by the reference LED 21 and LED chains 15, 16, and 17.

In one example, the LED chain 15 can be used to detect light from the reference LED 21 and the LED chains 16 and 17, and the LED chain 16 can be used to detect light from the reference LED and the LED chain 15. For this example, in a first step, LED chain 15 is used by driver/receiver circuitry 31 and control circuitry 13 to measure and determine the ratio of light produced by LED 21 over the light produced by LED chain 16 and the ratio of light produced by LED 21 over the light produced by LED chain 17. In a second step, LED chain 16 is used by driver/receiver circuitry 31 and control circuitry 13 to measure and determine the ratio of light produced by LED 21 over the light produced by LED chain 15. In a third step, the LED current magnitude or duty cycle of the drive currents provided by driver/receiver 31 to LED chains 15, 16, and 17 are adjusted until the ratio of light produced by LED 21 over LED chain 15, the ratio of light produced by LED 21 over LED chain 16, and the ratio of light produced by LED 21 over LED chain 17 are equal to desired values, which can be the same pre-determined fixed value, if desired. It is further noted that in addition to producing drive currents for the LED chains 15, 16 and 17, the driver/receiver circuitry 31 is also used to detect current induced in LED chains 15 and 16 when being used as light detectors.

FIG. 3 is just one of many possible block diagrams for an improved LED lamp 30 that can be configured to use a reference LED 21 without an additional light detector 22 to maintain a fixed brightness over lifetime. The example LED lamp 30 can have any number of two or more LED chains with any number of LEDs in each chain (e.g., one or more), as desired, depending upon an implementation being utilized for lamp 30. The LEDs can also be any desired color; however, the two LED chains that are used as light detectors are preferably the same color. For example, with respect to the three LED chains as depicted in FIG. 3, LED chain 17 could be implemented as white LEDs, and the LED chains 15 and 16 could also be used as light detectors and implemented as red LEDs. It is further noted that the combination of the white LED chain 17 with the red LED chains 15 and 16 can be used to produce what is often called "warm" white light, if desired. The reference LED 21 can also be implemented as a blue LED, if desired. Other configurations of LEDs could also be used, as desired.

It is further noted that other variations could also be implemented with respect to the above embodiments, as desired, and numerous variations and modifications will become apparent to those skilled in the art once the above disclosure is fully appreciated.

What is claimed is:

1. An illumination device, comprising:

one or more illumination LEDs configured to provide illumination for the illumination device;

at least one reference LED configured to provide illumination only during test times of the illumination device;

driver circuitry coupled to the one or more illumination LEDs and the at least one reference LED;

light detector circuitry configured during the test times to detect light from the one or more illumination LEDs and the at least one reference LED; and control circuitry coupled to the light detector circuitry and to the driver circuitry, the control circuitry being configured to utilize a—comparison of light detected from the reference LED and light detected from the one or more illumination LEDs to adjust a brightness of the illumination device through control of the driver circuitry.

2. The illumination device as recited in claim 1, wherein the light detector circuitry comprises a photo-detector configured to detect light produced by the reference LED and light produced by the one or more illumination LEDs.

3. The illumination device as recited in claim 1, wherein at least two illumination LEDs are used to produce the illumination for the device.

4. The illumination device as recited in claim 3, wherein the light detector circuitry comprises at least one of the illumination LEDs.

5. The illumination device as recited in claim 4, wherein a first illumination LED—is utilized to detect light produced by the reference LED and to detect light produced by a second illumination LED, and wherein the control circuitry is configured to:

determine a ratio of the light detected from the reference LED over the light detected from the second illumination LED;

compare the ratio to a first desired value; and adjust a magnitude or duty cycle of a drive current provided by the driver circuitry to the second illumination LED until the ratio is equal to the first desired value.

6. The illumination device as recited in claim 5, wherein the second illumination LED is used to detect light produced by the reference LED and to detect light produced by the first illumination LED, and wherein the control circuitry is further configured to:

determine a ratio of the light detected from the reference LED over the light detected from the first illumination LED;

compare the ratio to a second desired value; and adjust a magnitude or duty cycle of a drive current provided by the driver circuitry to the first illumination LED until the ratio is equal to the second desired value.

7. The illumination device as recited in claim 6, wherein the control circuitry is configured to control the driver circuitry to adjust the brightness of the illumination device produced by the first and second illumination LEDs based upon the comparison of the ratio of the light detected from the reference LED over the light detected from the first illumination LED to the second desired value, and further based on the comparison of the ratio of the light detected from the reference LED over the light detected from the second illumination LED to the first desired value.

8. The illumination device as recited in claim 7, further comprising at least a third illumination LED, and wherein the first illumination LED is also used to detect light produced by the third illumination LED.

9. The illumination device as recited in claim 8, wherein the control circuitry is further configured to control the driver circuitry to adjust the brightness of the illumination device produced by the illumination LEDs based upon a—comparison of a ratio of the light detected from the reference LED over the light detected from the third illumination LED to a third desired value.

10. The illumination device as recited in claim 9, wherein the first illumination LED and the second illumination LED comprise red LEDs, wherein the third illumination LED comprises a white LED, and wherein the reference LED comprises a blue LED.

11. A method for controlling a brightness of an illumination device, comprising:

detecting light produced by a reference LED of the illumination device, wherein the reference LED only produces light during test times and not during normal illumination operation of the illumination device;

detecting light produced by one or more illumination LEDs of the illumination device;

comparing the light produced by the reference LED to the light produced by the one or more illumination LEDs; and adjusting the brightness of the illumination device based upon the comparing step.

12. The method as recited in claim 11, further comprising utilizing a photo-detector configured to perform the detecting steps.

13. The method as recited in claim 11, further comprising using at least two illumination LEDs to produce illumination for the illumination device.

14. The method as recited in claim 13, further comprising utilizing at least one of the illumination LEDs to perform the detecting steps.

15. The method as recited in claim 14, further comprising utilizing a first illumination LED—to detect light produced by the reference LED and to detect light produced by a second illumination LED, wherein the comparing step comprises determining a ratio of the light detected from the reference LED over the light detected from the second illumination LED and comparing the ration to a first desired value, and wherein the adjusting step comprises adjusting a magnitude or duty cycle of a drive current provided to the second illumination LED until the ratio is equal to the first desired value.

16. The method as recited in claim 15, further comprising utilizing the second illumination LED to detect light produced by the reference LED and to detect light produced by the first illumination LED, and wherein the comparing step comprises determining a ratio of the light detected from the reference LED over the light detected from the first illumination LED and comparing the ratio to a second desired value, and wherein the adjusting step comprises adjusting a magnitude or duty cycle of a drive current provided to the first illumination LED until the ratio is equal to the second desired value.

17. The method as recited in claim 16, wherein the adjusting step comprises adjusting the brightness of the illumination device based upon the comparison of the ratio of the light detected from the reference LED over the light detected from the first illumination LED to the second desired value, and further based upon the comparison of the ratio of the light detected from the reference LED over the light detected from the second illumination LED to the first desired value.

18. The method as recited in claim 17, further comprising using at least a third illumination LED to produce illumination for the illumination device, and further comprising utilizing the first illumination LED to detect light produced by the third illumination LED.

19. The method as recited in claim 18, further comprising adjusting the brightness of the illumination device based upon a comparison of a ratio of the light detected from the reference LED over the light detected from the third illumination LED to a third desired value.

20. The method as recited in claim 18, wherein the first illumination LED and the second illumination LED comprise red LEDs, wherein the third illumination LED comprises a white LED, and wherein the reference LED comprises a blue LED.

* * * * *